US009434056B2

(12) United States Patent
Seith et al.

(10) Patent No.: US 9,434,056 B2
(45) Date of Patent: Sep. 6, 2016

(54) IMPACT TOOLS WITH PRESSURE VERIFICATION AND/OR ADJUSTMENT

(71) Applicant: Ingersoll-Rand Company, Davidson, NC (US)

(72) Inventors: Warren A. Seith, Bethlehem, PA (US); Aaron M. Crescenti, Glen Gardner, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 468 days.

(21) Appl. No.: 14/104,039

(22) Filed: Dec. 12, 2013

(65) Prior Publication Data

US 2015/0165602 A1 Jun. 18, 2015

(51) Int. Cl.

| | |
|---|---|
| ***B25B 21/02*** | (2006.01) |
| ***B25F 3/00*** | (2006.01) |
| ***B26B 11/00*** | (2006.01) |
| ***B25B 23/142*** | (2006.01) |
| ***B25B 13/56*** | (2006.01) |
| *B25B 23/00* | (2006.01) |
| *B26B 1/04* | (2006.01) |

(52) U.S. Cl.

CPC ..... *B25B 21/02* (2013.01); *B25B 13/56* (2013.01); *B25B 23/0007* (2013.01); *B25B 23/1427* (2013.01); *B25F 3/00* (2013.01); *B26B 11/003* (2013.01); *B25B 23/0021* (2013.01); *B26B 1/046* (2013.01)

(58) Field of Classification Search

CPC ..... B25B 13/56; B25B 23/0007; B25B 23/0021; B25B 23/0028; B25B 23/1427; B25B 21/02; B25F 1/003; B25F 3/00; B26B 1/048; B26B 1/046; B26B 11/003; B26B 11/008

USPC ..... 173/20, 90, 217, 171, 29, 93, 93.5; 7/163, 164, 168, 100, 119, 128, 129; 73/146.3, 714, 146.8; 417/63, 234, 417/223, 319, 423.14, 442; 81/28, 177.6, 81/177.7, 177.85, 440

See application file for complete search history.

(56) References Cited

U.S. PATENT DOCUMENTS

| | | | |
|---|---|---|---|
| 2,160,150 | A | 5/1939 | Jimerson et al. |
| 3,661,217 | A | 5/1972 | Maurer |
| 4,250,759 | A | 2/1981 | Vago et al. |
| 4,526,030 | A | 7/1985 | Vecera, Jr. |
| 4,704,901 | A | 11/1987 | Rocco et al. |

(Continued)

OTHER PUBLICATIONS

Black & Decker, "High Performance Cordless Inflator," 2013, 3 pages.

(Continued)

*Primary Examiner* — Scott A. Smith
(74) *Attorney, Agent, or Firm* — Barnes & Thornburg LLP

(57) ABSTRACT

Illustrative embodiments of impact tools having pressure verification and/or adjustment systems are disclosed. According to at least one illustrative embodiment, an impact tool may comprise a housing, an impact mechanism supported in the housing, a motor supported in the housing, and a pressure probe coupled to the housing. The impact mechanism may be configured to drive rotation of an output shaft about a first axis, the motor may be configured to drive the impact mechanism when energized, and the pressure probe may be configured to couple to a valve of a motor vehicle tire to measure an air pressure of the motor vehicle tire.

20 Claims, 9 Drawing Sheets

(56) References Cited

U.S. PATENT DOCUMENTS 5,148,704 A * 9/1992 Tsai ..... G01L 17/00 340/442
5,771,516 A * 6/1998 Huang ..... B25F 3/00 254/122
5,931,207 A * 8/1999 Gianino ..... B05B 9/0805 137/223
5,960,836 A * 10/1999 McInnes ..... B60C 29/062 141/1
6,024,139 A * 2/2000 McInnes ..... B60C 29/062 141/38
6,341,423 B1 * 1/2002 Taggart ..... B25F 1/003 30/143
6,468,047 B1 10/2002 Huang et al.
6,485,276 B2 * 11/2002 Yang ..... F04B 41/00 417/234
6,546,815 B2 4/2003 Yamada et al.
6,607,111 B2 8/2003 Garvis et al.
6,773,132 B2 * 8/2004 Gilligan ..... B60B 29/00 152/416
6,843,327 B2 1/2005 Meixner et al.
6,877,200 B2 * 4/2005 Villarreal ..... B66F 3/247 152/416
7,051,525 B2 5/2006 Keskiniva et al.
7,089,099 B2 8/2006 Shostak et al.
7,348,878 B2 3/2008 Fogelstrom
7,494,035 B2 * 2/2009 Weaver ..... B25C 1/04 173/217
7,611,127 B1 * 11/2009 Moore ..... B25B 21/02 254/122
8,365,331 B1 * 2/2013 Young ..... B25B 21/002 254/1
2004/0016058 A1 * 1/2004 Gardiner ..... B25F 1/04 7/119
2005/0005693 A1 1/2005 Huang
2006/0032647 A1 * 2/2006 Petty ..... F41B 11/724 173/169
2008/0109966 A1 * 5/2008 Gilkerson ..... F21V 33/0084 7/100
2010/0200260 A1 8/2010 Mikami et al.
2013/0145834 A1 6/2013 Mouchet
2014/0259438 A1 * 9/2014 Rubin ..... B25F 1/006 7/163

OTHER PUBLICATIONS

Life-Plicity, "The Life-Plicity Multi-Tool Tire Pressure Gauge With Multi Safety Features," 2013, 3 pages.

* cited by examiner

IMPACT TOOLS WITH PRESSURE VERIFICATION AND/OR ADJUSTMENT

TECHNICAL FIELD

The present disclosure relates generally to impact tools. More particularly, the present disclosure relates to impact tools having pressure verification and/or adjustment systems.

BACKGROUND

An impact wrench or impact tool may be used to install and remove threaded fasteners. Impact tools generally include a motor coupled to an impact mechanism that converts the torque of the motor into a series of powerful rotary blows directed from a hammer to an output shaft called an anvil. While impact tools have many uses, impact tools are often used when installing and removing lug nuts that secure an automotive wheel or tire assembly to a vehicle. Impact tools are preferred in such situations because they offer reactionless operation (i.e., the user does not have to fight a reaction torque as the impact tool tightens or removes a fastener), they provide the ability to loosen stubborn fasteners, and they operate quickly and efficiently.

SUMMARY

According to one aspect, an impact tool may comprise a housing, an impact mechanism supported in the housing, a motor supported in the housing, and a pressure probe coupled to the housing. The impact mechanism may be configured to drive rotation of an output shaft about a first axis, the motor may be configured to drive the impact mechanism when energized, and the pressure probe may be configured to couple to a valve of a motor vehicle tire to measure an air pressure of the motor vehicle tire.

In some embodiments, the impact tool may further comprise a display supported by the housing. The display may be configured to provide an indication of the air pressure of the motor vehicle tire measured by the pressure probe.

In some embodiments, the housing may include a cavity formed therein, where the cavity is configured to receive the pressure probe when not in use. The pressure probe may be rotatably mounted within the cavity such that the pressure probe is configured to be rotated out of the cavity for use. The pressure probe may include a first arm rotatably mounted within the cavity and second arm rotatably mounted to the first arm.

In some embodiments, the pressure probe may be integrally formed as part of the housing. The pressure probe may extend along a second axis that is non-parallel to the first axis.

In some embodiments, the pressure probe may be further configured to adjust the air pressure of the motor vehicle tire. The impact tool may further comprise an air compressor supported in the housing and configured to be driven by the motor, and the pressure probe may be in fluid communication with the air compressor. The impact tool may be configured to be connected to an external source of pressurized air, and the pressure probe may be in selective fluid communication with the source of pressurized air.

In some embodiments, the impact tool may further comprise an implement holder coupled to the housing of the impact tool. The implement holder may be configured to a hold an implement that may be removably coupled the output shaft.

In some embodiments, the impact mechanism may comprise an anvil coupled to the output shaft and configured to rotate about the first axis. The impact mechanism may further comprise a hammer configured to rotate about the first axis to periodically deliver an impact blow to the anvil to cause rotation thereof.

According to another aspect, an impact tool may comprise a housing, a motor supported in the housing, an output shaft supported by the housing, where the output shaft is configured to rotate about a first axis, an impact mechanism supported in the housing, where the impact mechanism comprises an anvil coupled to the output shaft and a hammer configured to rotate when driven by the motor to periodically deliver an impact blow to the anvil to cause rotation of the anvil and the output shaft, a pressure probe coupled to the housing, where the pressure probe is configured to couple to a valve of a motor vehicle tire to measure an air pressure of the motor vehicle tire, and a display supported by the housing, where the display is configured to provide an indication of the air pressure of the motor vehicle tire measured by the pressure probe.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, the same or similar reference labels have been repeated among the figures to indicate corresponding or analogous elements.

DETAILED DESCRIPTION

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 1:
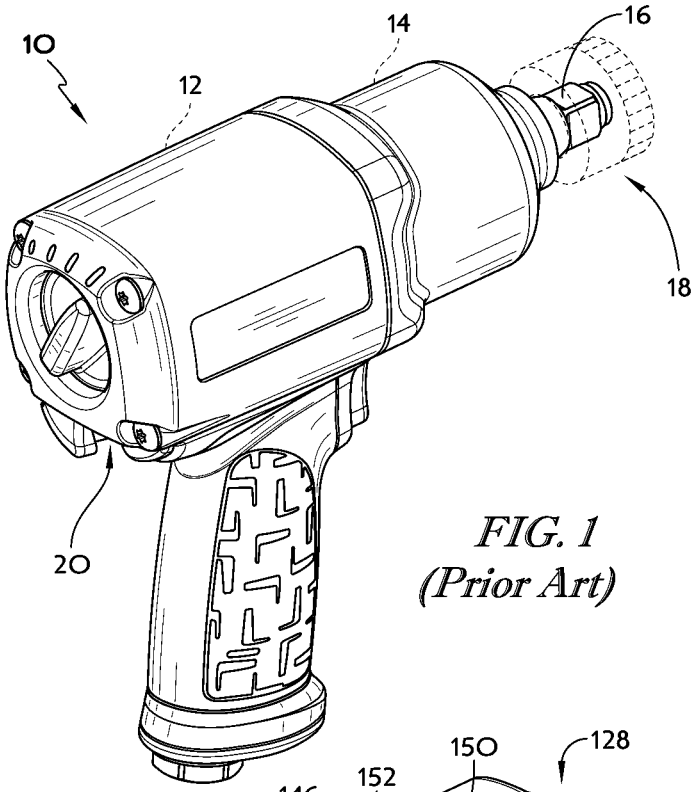
FIG. 1 (Prior Art)
FIG. 1 is a top, rear perspective view of an impact tool.

A prior art impact tool 10 is depicted in FIG. 1. The impact tool 10 generally includes a motor 12, an impact mechanism 14 driven by the motor 12, and an output shaft 16 driven for rotation by the impact mechanism 14. The motor 12 may illustratively be embodied as an electric motor or a pneumatic motor. The impact tool 10 has a forward output end 18 and a rear end 20. In some illustrative embodiments, the impact mechanism 14 of the impact tool 10 may be of the type commonly known as a "ball-and-cam" impact mechanism. U.S. Pat. No. 2,160,150 to Jimerson et al. (the entire disclosure of which is hereby incorporated by reference) describes at least one embodiment of such a ball-and-cam impact mechanism. In other illustrative embodiments, the impact mechanism 14 of the impact tool may be embodied as a "swinging-weight" type impact mechanism, such as those disclosed in U.S. Pat. No. 3,661,217 to Maurer (the entire disclosure of which is hereby incorporated by reference), by way of example. In still other illustrative embodiments, the impact tool 10 may include any other suitable impact mechanism 14. Further, it will be understood by one skilled in the art that the principles of the present disclosure may be implemented within any impact tool.

Figure 2A:
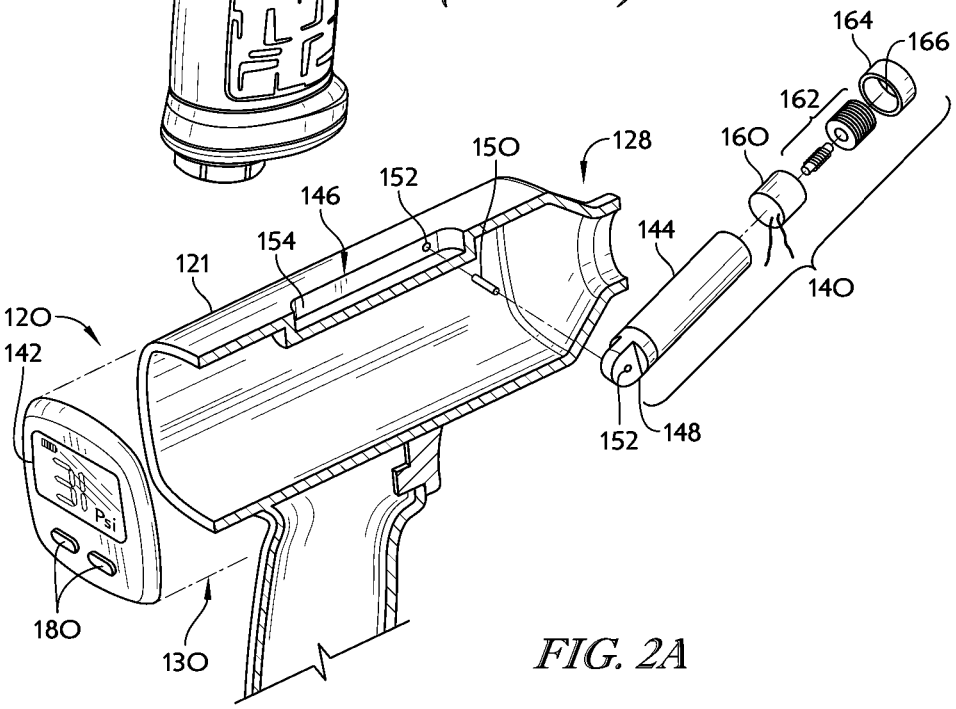
FIG. 2A is a top, rear perspective, partial cross-sectional, and partial exploded view of an impact tool, similar to the impact tool of FIG. 1, with internal components removed therefrom and incorporating a first illustrative embodiment of a pressure verification and/or adjustment system.
Figure 2B:
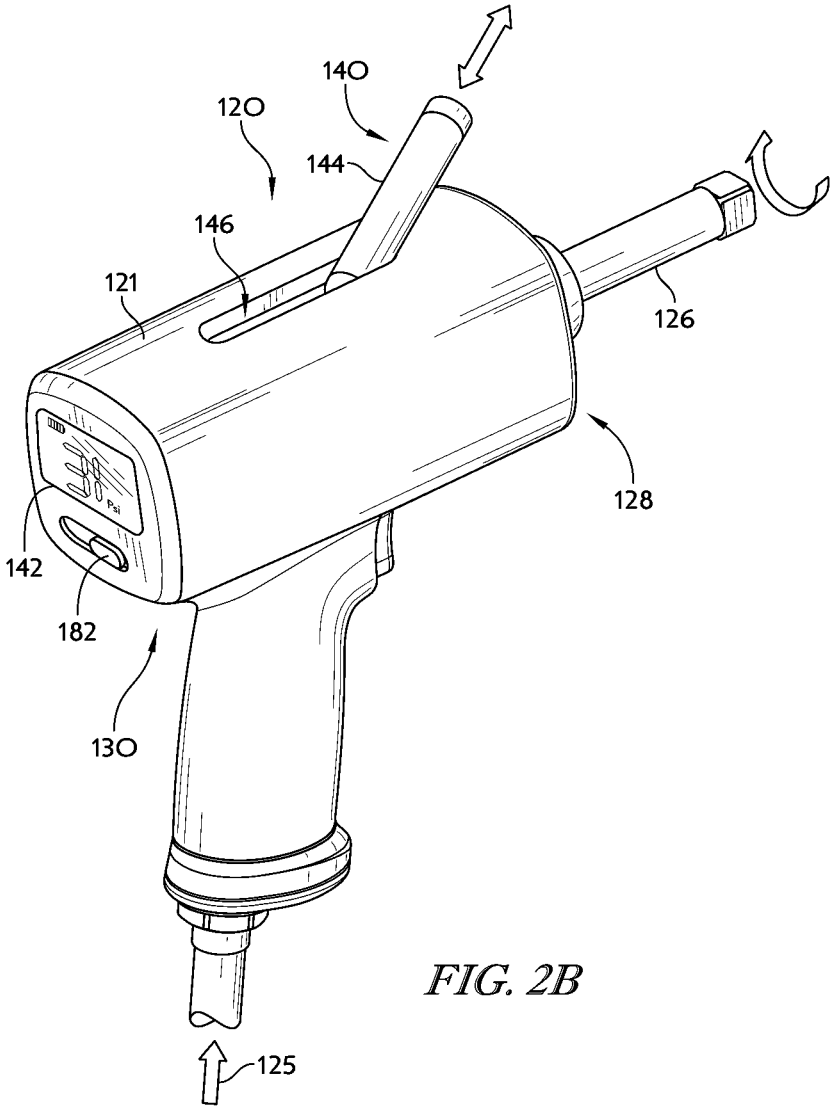
FIG. 2B is a top, rear perspective view of the impact tool of FIG. 2A.

Referring now to FIGS. 2A-D, exemplary impacts tools 120 incorporating illustrative embodiments of a pressure verification and/or adjustment system are depicted. The impact tools 120 each generally include a housing 121 supporting a motor 122, an impact mechanism 124 driven by the motor 122, and an output shaft 126 that extends from a forward output end 128 (opposite a rear end 130) of the housing 121 and is driven for rotation by the impact mechanism 124. In the illustrative embodiment of FIGS. 2A and 2B, the impact tool 120 includes a pneumatic motor 122 (not shown) that may be connected to an external source of pressurized air 125, as indicated in FIG. 2B. As described further below (with reference to FIG. 7), in some embodiments where the impact tool 120 is connected to an external source of pressurized air 125, the pressurized air 125 may be also be optionally supplied to the pressure verification and/or adjustment system (e.g., via an valve that diverts some or all of pressurized air 125 from the pneumatic motor 122 to the pressure verification and/or adjustment system of the impact tool 120).

Figure 2C:
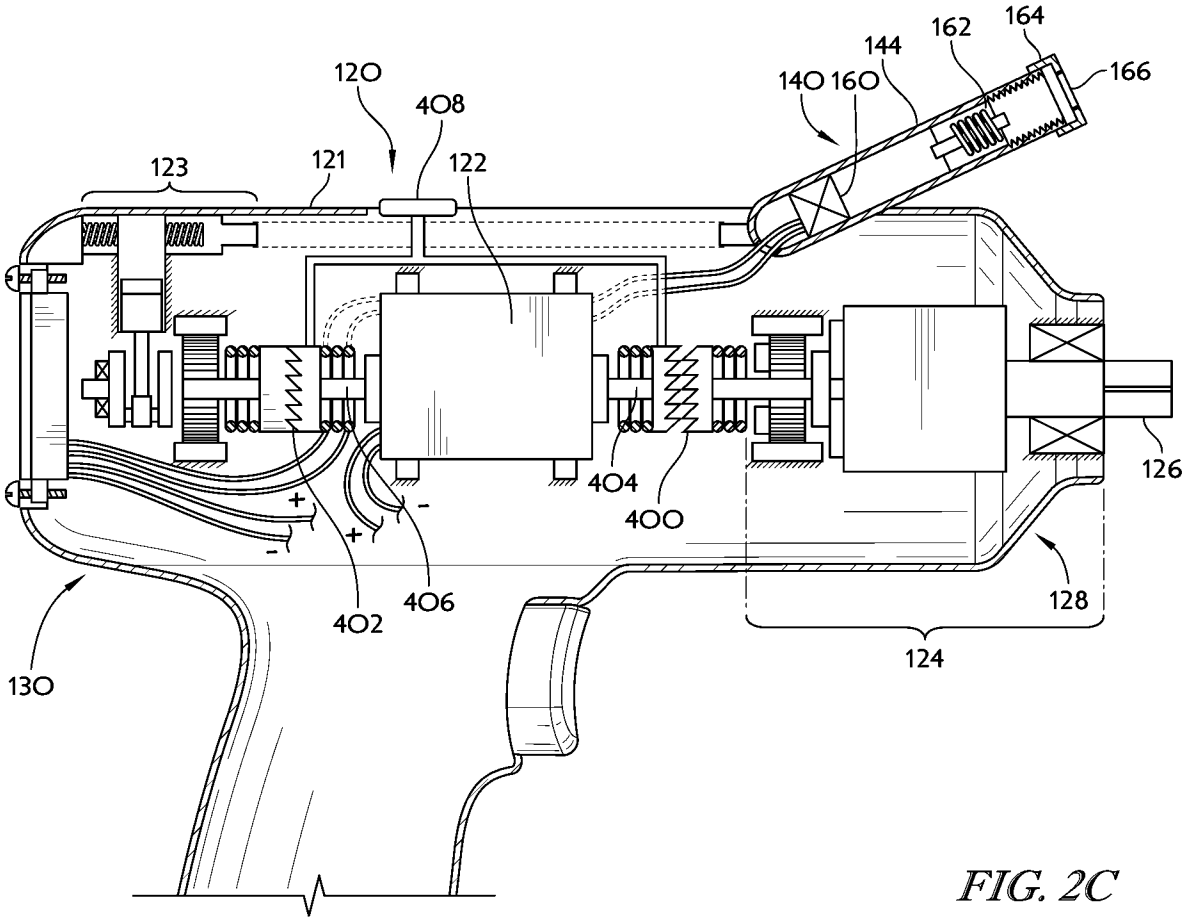
FIG. 2C is partial cross-sectional view of another impact tool, incorporating a second illustrative embodiment of a pressure verification and/or adjustment system.
Figure 2D:
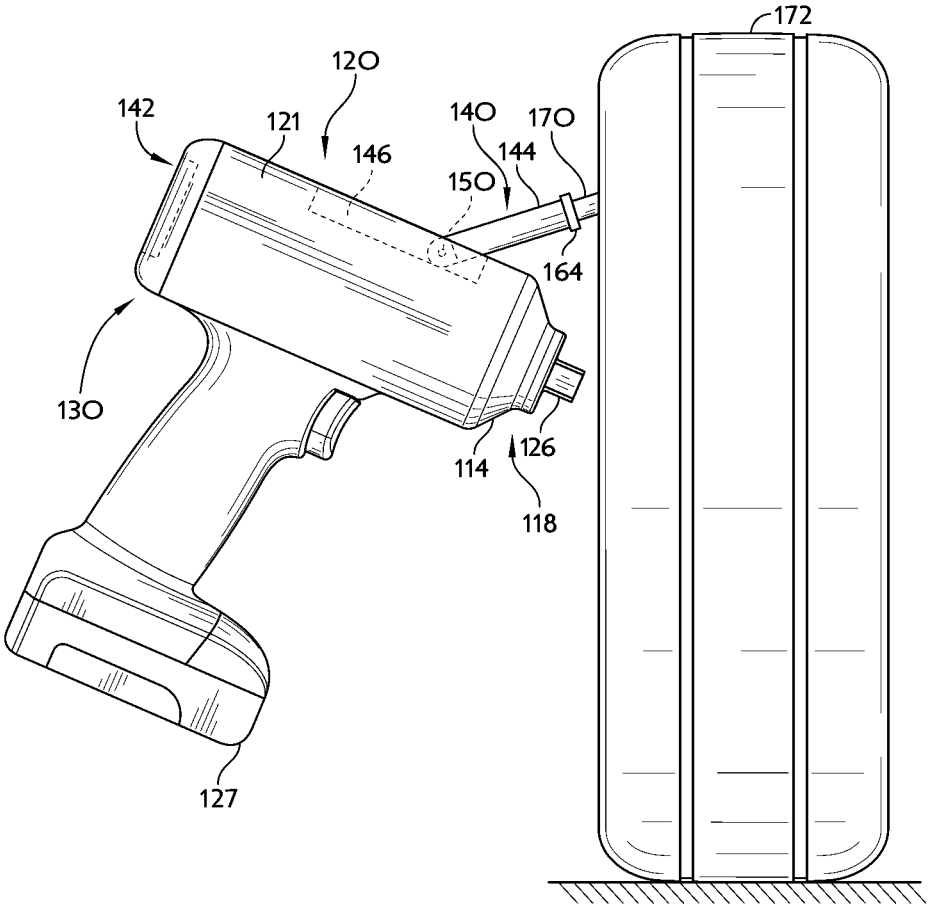
FIG. 2D is a side elevation view of the impact tool of FIG. 2C, with a pressure probe of the second illustrative embodiment of the pressure verification and/or adjustment system attached to a pressure valve of a tire to determine and/or adjust a pressure thereof.

In the illustrative embodiment of FIGS. 2C and 2D, the impact tool 120 instead includes an electric motor 122 (rather than a pneumatic motor). The electric motor 122 may be connected to a rechargeable battery 127 removably coupled to the impact tool 120 (as shown in FIG. 2D) or to an external source of electrical power. As shown in FIG. 2C and further described below, in some embodiments where the impact tool 120 includes an electric motor 122 and is not connected to an external source of pressurized air 125, the impact tool 120 may optionally include an air compressor assembly 123 that provides an onboard source of pressurized air for the pressure verification and/or adjustment system.

The pressure verification and/or adjustment system of FIGS. 2A-D includes a pressure probe 140 and a display 142 (illustratively shown as a digital display 142). In the illustrative embodiments of FIGS. 2A-D, the pressure probe 140 includes a body 144 that is connected to the housing 121 of the impact tool 120. In these illustrative embodiments, the housing 121 of the impact tool 120 includes a cavity 146 in which the pressure probe 140 may be stored while not in use. More particularly, one end 148 of the body 144 of the pressure probe 40 may be attached to the impact tool 120 by inserting a pin 150 through holes 152 formed in the end 148 of the body 144 and in opposing walls 154 (one shown) bounding the cavity 146. In this manner, the pressure probe 140 may be rotated into the cavity 146 for storage or out of the cavity 146 for use. In the illustrative embodiments shown in FIGS. 2A-D, the pressure probe 140 may be stored within the cavity 146 such that no portion of the pressure probe 140 extends beyond an outer surface of the housing 121 of the impact tool 120. In alternative illustrative embodiments, the pressure probe 140 may partially protrude out of the cavity 146 during storage. In some embodiments, the pin 150 may extend into elongate slots within the walls 154 such that the pin 150 may slide along the slots and, thus, along the cavity 146. In still other embodiments, the pressure probe 40 may be removably stored within the cavity 146 such that the pressure probe 140 may be entirely removed from the cavity 146 and moved in any dimension relative to the housing 121 of the impact tool 120.

As seen in FIGS. 2A and 2C, the pressure probe 140 may further include a pressure sensor 160 and a valve 162 (e.g., a "Schrader" valve) held within the body 144 by an end cap 164 having an inlet 166. The pressure probe 140 may function similarly to known pressure sensing devices to measure the internal pressure of, for example, a tire 172. When the pressure probe 140 is rotated to a use position, the inlet 166 may receive a valve stem 170 of a tire 172 (e.g., the tire of a motor vehicle), as shown in FIG. 2D. The pressure sensor 160 is electrically connected to a processor incorporated within the display 142 (or, alternatively, within another part of the impact tool 120), which is configured to receive the electrical signals from the pressure sensor 160 and to present the sensed pressure of the tire 172 on the display 142. In some embodiments, the display 142 may present any additional information, such as previous sensed pressures, battery life, supplied air pressure, and/or any other relevant information. The display 142 may also include other input and output features, including, but not limited to, various buttons 180 (see, e.g., FIG. 2A), switches 182 (see, e.g., FIG. 2B), and/or lights. In some illustrative embodiments, one or more buttons 180 may be utilized to illuminate the display 142, turn the display 142 on and/or off, reset the pressure on the display 142, or perform any other desired function(s). Additionally or alternatively, a selector switch 182 may be provided on the display 142 (or on the housing 121) to activate the pressure sensor 160 of the pressure probe 140, control the supply of pressurized air to the pressure probe 140, or perform any other desired function(s).

Figure 3A:
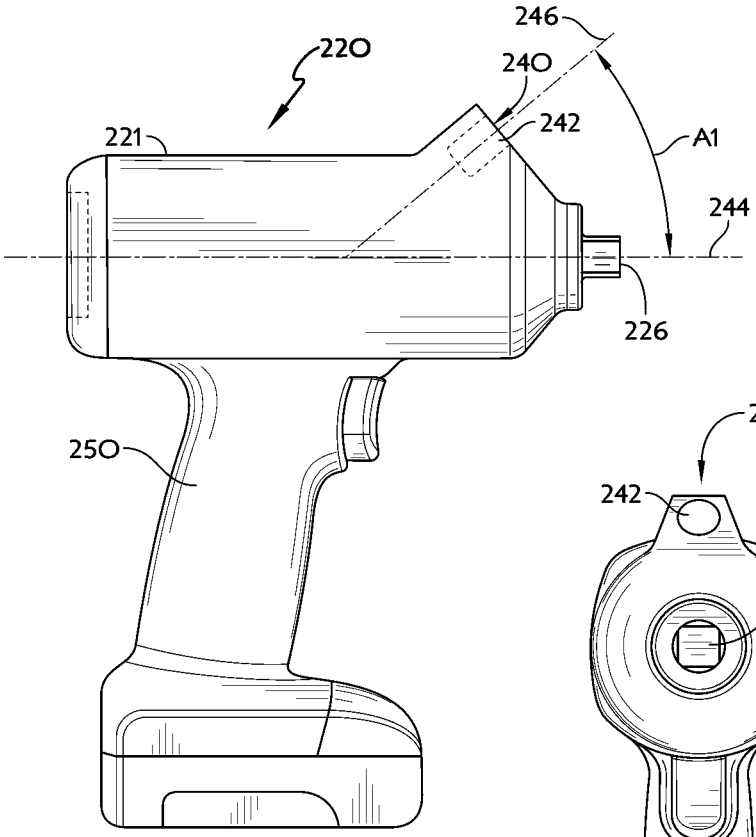
FIG. 3A is a side elevation view of another impact tool, incorporating a third illustrative embodiment of a pressure verification and/or adjustment system.
Figure 3B:
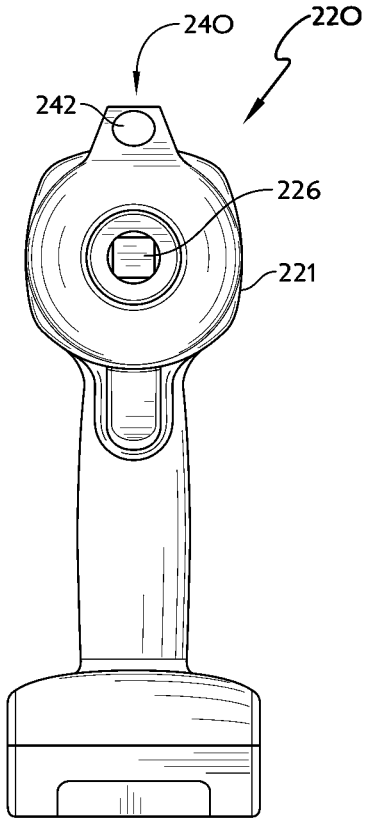
FIG. 3B is a front elevation view of the impact tool of FIG. 3A.

An impact tool 220 incorporating another illustrative embodiment of a pressure verification and/or adjustment system is depicted in FIGS. 3A and 3B. The internal components of the impact tool 220 may be similar to any of the other impact tools described herein. The impact tool 220 includes a housing 221 that integrally incorporates a pressure probe 240. In this illustrative embodiment, the pressure probe 240 is fixedly formed as part of the housing 221. In particular, the components of the pressure probe 240 may be positioned within the housing and an inlet 242 for the pressure probe 240 may be molded or otherwise fixedly formed as part of the housing 221, thereby providing rigidity to the pressure probe 240 and the inlet 242. It is contemplated that the pressure probe 240 may be formed in any portion of the housing 221 of the impact tool 220. In illustrative embodiments, an insertion axis 246 of the pressure probe 240 may be positioned at an angle A1 with respect to an output axis 244 of the impact tool 220 to allow a user to grasp a handle 250 of the impact tool 220, tilt the impact tool 220, and insert a valve stem (e.g., of a tire) into the inlet 242 along the insertion axis 246. The angle A1 prevents interference between the pressure probe 240 and an output shaft 226 of the impact tool 220 during operation of one or the other. While not specifically depicted in FIGS. 3A and 3B, the pressure verification and/or adjustment system of the impact tool 220 may also include a display, as disclosed with respect to the illustrative embodiment of FIGS. 2A-2D. Likewise, the pressure probe 240 may include similar internal components to the pressure probe 140 of the illustrative embodiments of FIGS. 2A-2D.

Figure 4A:
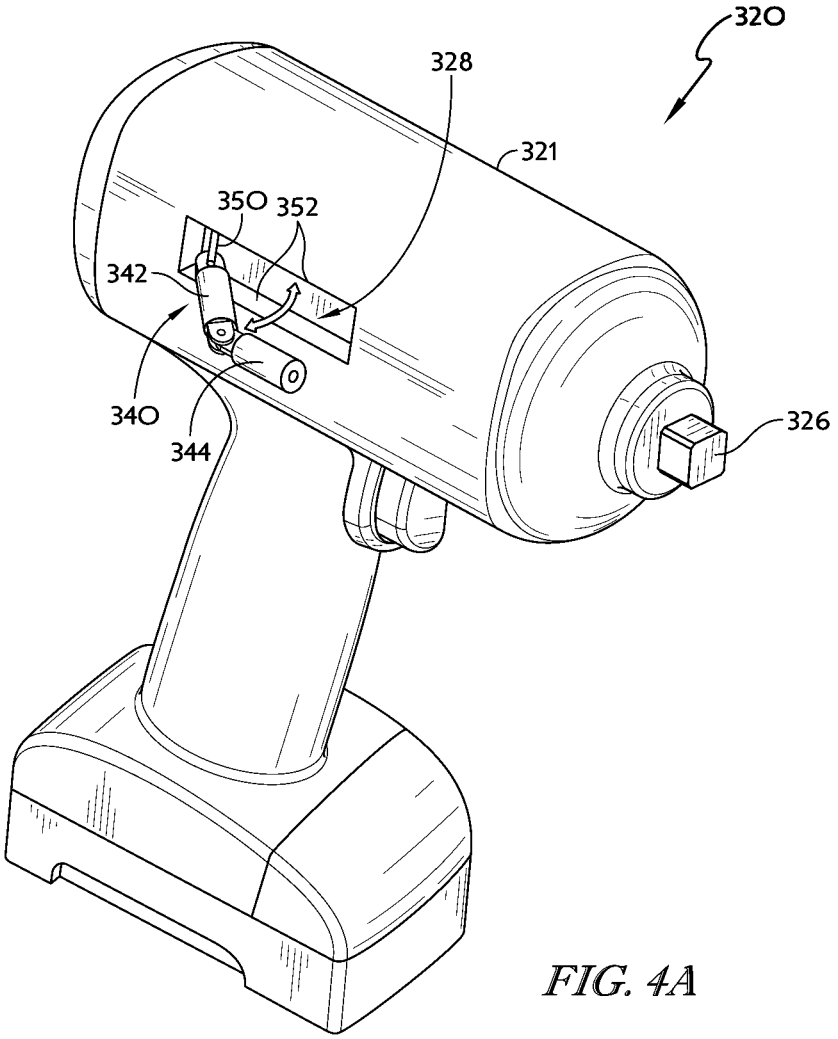
FIG. 4A is a top, front perspective view another impact tool, incorporating a fourth illustrative embodiment of a pressure verification and/or adjustment system.
Figure 4B:
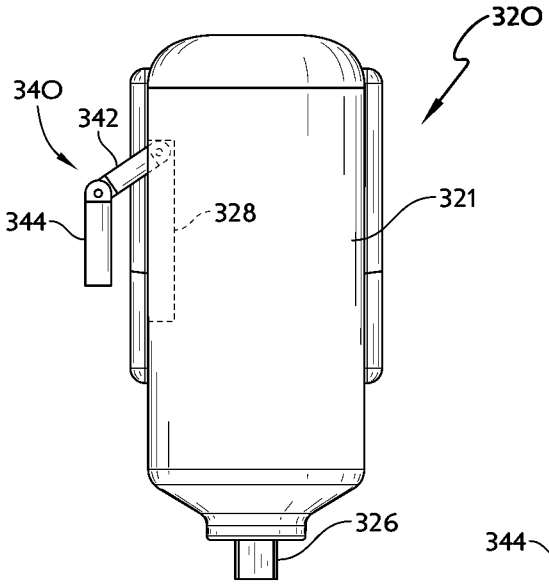
FIG. 4B is a top elevation view of the impact tool of FIG. 4A.
Figure 4C:
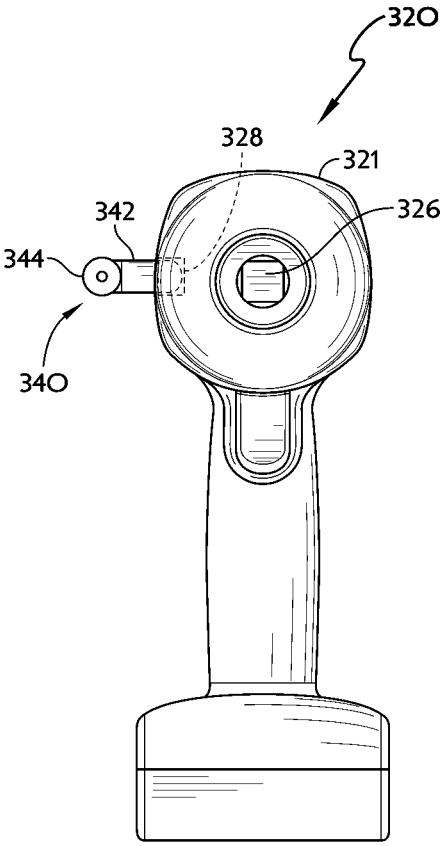
FIG. 4C is a front elevation view of the impact tool of FIG. 4A.

An impact tool 320 incorporating another illustrative embodiment of a pressure verification and/or adjustment system is depicted in FIGS. 4A-C. The internal components of the impact tool 320 may be similar to any of the other impact tools described herein. The impact tool 320 includes a housing 321 supporting a motor, an impact mechanism driven by the motor, and an output shaft 326 that extends from the housing 321 and is driven for rotation by the impact mechanism. The impact tool 320 also includes a pressure probe 340 and a display (not shown), which are generally similar to those described in detail above with reference to FIGS. 2A-2D. The pressure probe 340 of the impact tool 320, however, includes two or more arms 342, 344 that may be attached by pins, or any other fasteners, that allow the arms 342, 344 to articulate with respect to one another. A cavity 328 may be formed within a portion of the housing 321 for storage of the pressure probe 340 when not in use. In the illustrative embodiment shown in FIGS. 4A-C, the pressure probe 340 is coupled to the housing 321 by inserting a pin 350 through holes (not shown) formed in the arm 342 and in opposing walls 352 bounding the cavity 328. In this manner, the arm 342 of the pressure probe 340 may be rotated into the cavity 328 for storage of the pressure probe 340 or out of the cavity 328 for use. Furthermore, the arm 344 may be rotated about the arm 342 to bend the pressure probe 340 into a desired orientation. In this manner, the pressure probe 340 provides additional flexibility in maneuvering, for example, into small or oddly shaped spaces.

Figure 5:
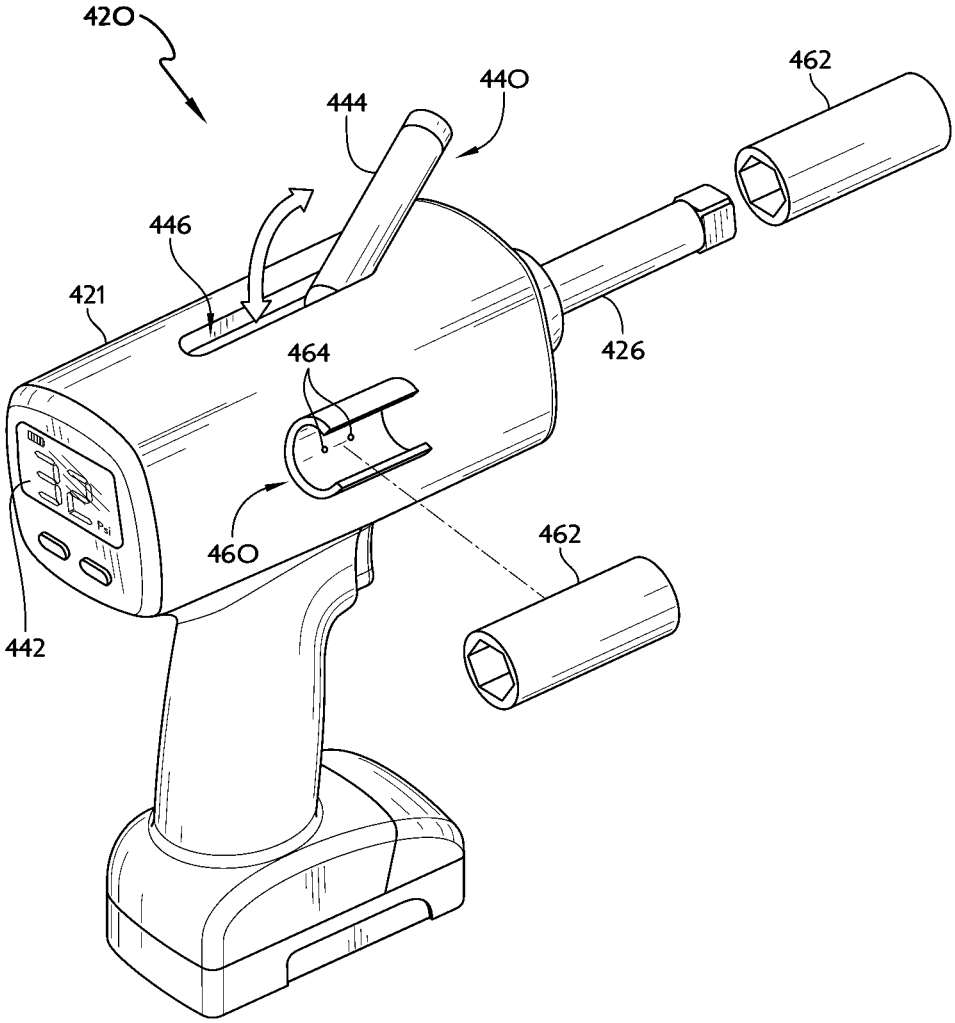
FIG. 5 is a top, rear perspective view of another impact tool, incorporating a fifth illustrative embodiment of a pressure verification and/or adjustment system.

Yet another illustrative embodiment of an impact tool 420 having a pressure verification and/or adjustment system is depicted in FIG. 5. The internal components of the impact tool 420 may be similar to any of the other impact tools described herein. The impact tool 420 includes a housing 421 supporting a motor, an impact mechanism driven by the motor, and an output shaft 426 that extends from the housing 421 and is driven for rotation by the impact mechanism. While the impact tool 420 is shown in FIG. 5 as an electrically powered tool (e.g., having an electric motor and optionally including an air compressor assembly), the impact tool 420 may alternatively be a pneumatically powered tool connected to an external source of pressurized air. The pressure verification and/or adjustment system of the impact tool 420 includes a pressure probe 440 and a pressure display 442, which are similar in structure and operation to the pressure probe 140 and the display 142 described above with reference to FIGS. 2A-D (but, alternatively, might be similar to any of the other pressure verification and/or adjustment systems described herein). In particular, the pressure probe 440 includes a body 444 that may rotated in and out of a cavity 446 formed in the housing 421 of the impact tool 420. As shown in FIG. 5, the impact tool 420 also includes an implement holder 460, for example, in the form of a socket clip, coupled to the housing 421. The implement holder 460 may be integral with or otherwise attached (e.g., by screws or other fasteners 464) to the housing 421 of the impact tool 420. The illustrative implement holder 460 is configured to hold, for example, a double-sided socket 462. It is contemplated that any number of implement holders 460 may be coupled to the housing 421 to hold any number of sockets 462 and/or any other implements for attachment to the output shaft 426. The implement holder(s) 460 provide easy access to implements during use of the impact tool 420.

Figure 6:
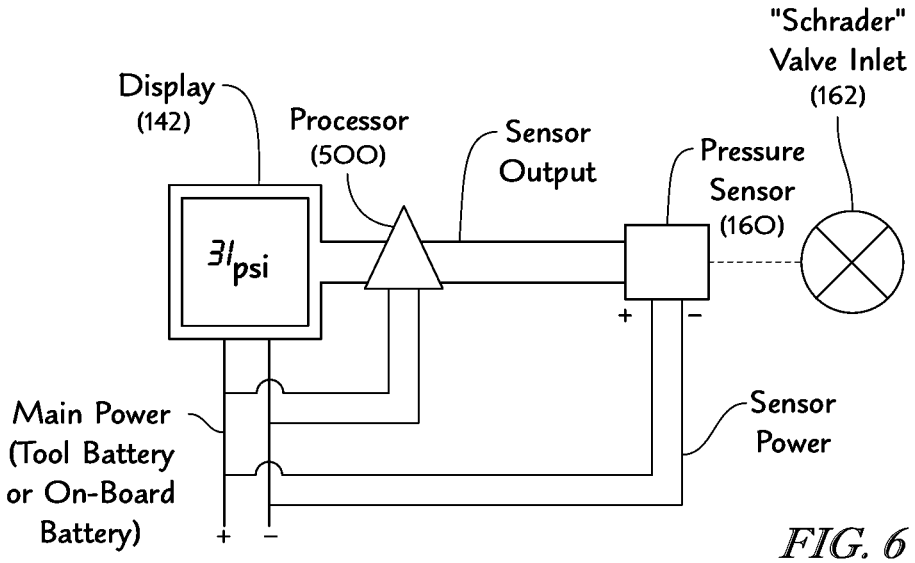
FIG. 6 is a basic system schematic for any of the pressure verification and/or adjustment systems disclosed herein.

Any of the pressure verification and/or adjustment systems of the impact tools 120, 220, 320, 420 described herein may be coupled to a tire valve stem 170 to measure a pressure of a tire 172 (as illustratively shown in FIG. 2D). A basic system diagram showing the electrical components of the presently disclosed pressure verification and/or adjustment systems that allow for such measurement of the pressure of the tire 172 is depicted in FIG. 6 (and will be illustratively described with reference to the pressure verification and/or adjustment system of FIGS. 2A-2D). The valve 162 (e.g., a Schrader valve) of the pressure probe 140 is fluidly coupled to the pressure sensor 160. The pressure sensor 160 is electrically coupled to a processor 500 that receives electrical signals regarding sensed pressure(s) from the pressure sensor 160. The processor 500 is electrically coupled to the display 142 to generate an indication of the sensed pressure(s) on the display 142. As mentioned above, in some embodiments, the processor 500 may be incorporated into the display 142. Each of the pressure sensor 160, the processor 500, and the display 142 is electrically coupled to an electrical power source of the impact tool 120. For instance, where the motor 112 of the impact tool 120 is electrically powered (such as FIGS. 2C and 2D), the pressure sensor 160, the processor 500, and the display 142 may draw electrical power from a rechargeable battery 127 coupled to the impact tool 120. In embodiments where the motor 112 of the impact tool 120 is pneumatically powered (such as FIGS. 2A and 2B), a small battery may be incorporated directly into the pressure verification and/or adjustment system to provide power to the pressure sensor 160, the processor 500, and the digital display 142.

In some illustrative embodiments, any of the pressure verification and/or adjustment systems of the impact tools 120, 220, 320, 420 described herein may further be configured to adjust the pressure of the tire 172 via the tire valve stem 170 to which the pressure probe 140, 240, 340, 440 is coupled. For example, in some illustrative embodiments, the pressure probe 140 may be operable to selectively bleed air from the tire 172 to decrease the pressure of the tire 172. In some embodiments, a button 180 or switch 182 of the display 142 (or another user input mechanism located in any suitable position on the housing 121 of the impact tool 120) may be operated by a user to selectively allow air to pass through the pressure probe 140 and be vented to the atmosphere.

Figure 7:
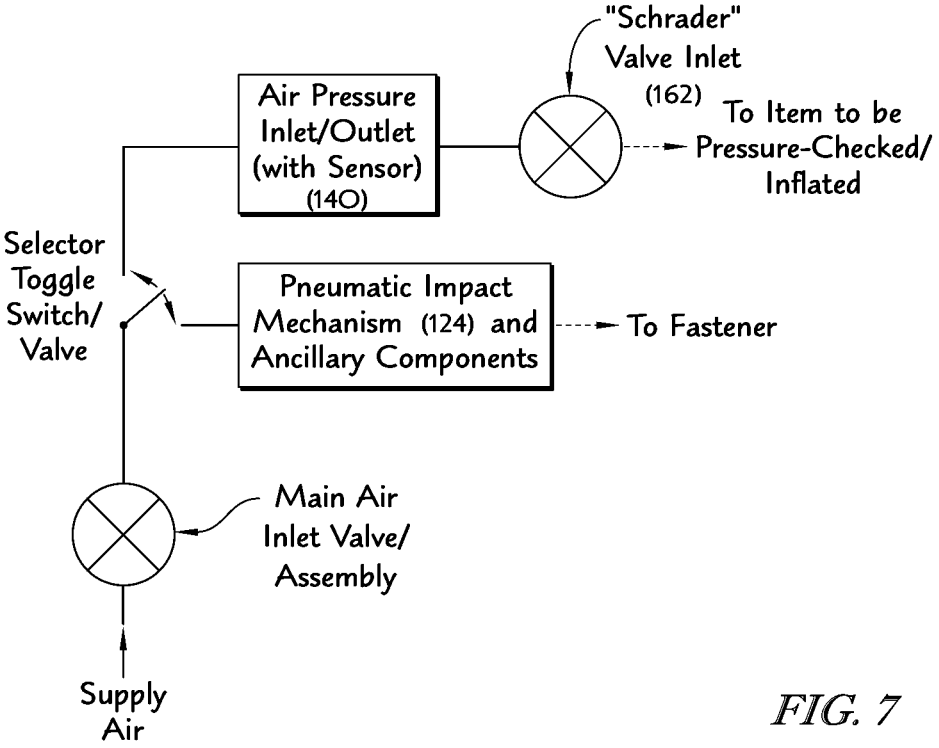
FIG. 7 is a system diagram for an exemplary pneumatic impact tool with pressure verification and/or adjustment capabilities.

In some illustrative embodiments, any of the pressure verification and/or adjustment systems of the impact tools 120, 220, 320, 420 described herein may further be configured to increase the pressure of the tire 172 by supplying additional pressurized air to the tire valve stem 170 via the pressure probe 140, 240, 340, 440. One illustrative system diagram for an exemplary pneumatic impact tool (such as the impact tool 120 of FIGS. 2A and 2B) with such a pressure verification and adjustment system is depicted in FIG. 7. As described above, the impact tool 120 is provided with pressurized air 125 (from an external source) through an inlet valve. A selector switch or valve incorporated in the impact tool 120 may be used to selectively direct air to the pneumatic motor 122 (to operate the impact mechanism 124 and cause rotation of the output shaft 126 to tighten or loosen a fastener) and/or to the pressure probe 140 (to supply pressured air to the tire valve stem 170 coupled to the valve 162 of the pressure probe 140). In some embodiments, a button 180 or switch 182 of the display 142 (or another user input mechanism located in any suitable position on the housing 121 of the impact tool 120) may be operated by a user to toggle the selector switch or valve. In this manner, at least a portion of the pressurized air 125 may be diverted from the pneumatic motor 122 for use in increasing the air pressure of the tire 172.

In embodiments in which the impact tool is not connected to an external source of pressurized air (for example, the electrically powered impact tool 120 of FIGS. 2C and 2D or the electrically powered impact tools 220, 320, 420 of FIGS. 3A-5), the impact tool may include an on-board air compressor 123, one illustrative embodiment of which is shown in partial cross-section in FIG. 2C. The air compressor 123 may be fluidly coupled to the pressure probe 140 of the impact tool 120 to supply pressurized air to the pressure probe 140 when the air compressor 123 is operated. As shown in FIG. 2C, a selector switch 408 may be used to alternately engage and disengage forward and aft shut-off clutches 400, 402 connected to the electric motor 122 by forward and aft output shaft connections 404, 406. When rotation of the output shaft 126 of the impact tool 120 is desired, the forward shut-off clutch 400 is engaged and the electric motor 122 is used to drive the impact mechanism 124 to cause rotation of the output shaft 126 (while the aft shut-off clutch 402 remains disengaged). When operation of the air compressor 123 is desired, the selector switch 408 may be slid toward the rear end 130 of the impact tool 120 to engage the aft shut-off clutch 402 and to simultaneously disengage the forward shut-off clutch 400 (as shown in FIG. 2C). In this position, operation of the electric motor 122 will drive the air compressor 123 (rather than the impact mechanism 120), allowing the air compressor 123 to provide pressurized air to the pressure probe 140. The impact tool 120 may be returned to the other mode of operation by sliding the selector switch 408 toward the front end 128 of the impact tool 120.

If the pressure probe 140, 240, 340, 440 of any of the illustrative embodiments described herein is used to adjust pressure, the processor 500 may be used to achieve a desired pressure setting. In some illustrative embodiment, a user may be able to enter a desired pressure value, connect the pressure probe 140, 240, 340, 440 to a valve, and the processor 500 may control the pressure probe 140, 240, 340, 440 to supply and/or bleed pressurized air to/from the valve until the desired pressure is achieved. For example, the processor 500 might utilize an algorithm mimicking the technique of fractionally over-inflating the tire (i.e., above the desired pressure setting) and then bleeding down the pressure to the desired value.

Any one or more features of any of the pressure verification and/or adjustment systems disclosed herein may be incorporated (alone or in combination) into any impact tool. The presently disclosed impact tools including pressure verification and/or adjustment systems provide a single tool that is capable of both installing/removing fasteners (e.g., wheel lug nuts) and verifying/adjusting air pressure (e.g., tire pressure). This will typically reduce the amount of time and the number of tools required to perform various tasks related to vehicle wheel and/or tire installation, by way of example. The implement holder 460 shown in FIG. 5 may further reduce the amount of time needed to perform such tasks because additional implements are immediately available to a user.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

a housing;

an impact mechanism supported in the housing, the impact mechanism being configured to drive rotation of an output shaft about a first axis;

a motor supported in the housing, the motor being configured to drive the impact mechanism when energized; and a pressure probe coupled to the housing, the pressure probe being configured to couple to a valve of a motor vehicle tire to measure an air pressure of the motor vehicle tire.

2. The impact tool of claim 1, further comprising a display supported by the housing, the display being configured to provide an indication of the air pressure of the motor vehicle tire measured by the pressure probe.

3. The impact tool of claim 1, wherein the housing includes a cavity formed therein, the cavity being configured to receive the pressure probe when not in use.

4. The impact tool of claim 3, wherein the pressure probe is rotatably mounted within the cavity such that the pressure probe is configured to be rotated out of the cavity for use.

5. The impact tool of claim 3, wherein the pressure probe includes a first arm rotatably mounted within the cavity and second arm rotatably mounted to the first arm.

6. The impact tool of claim 1, wherein the pressure probe is integrally formed as part of the housing.

7. The impact tool of claim 1, wherein the pressure probe extends along a second axis that is non-parallel to the first axis.

8. The impact tool of claim 1, wherein the pressure probe is further configured to adjust the air pressure of the motor vehicle tire.

9. The impact tool of claim 8, further comprising an air compressor supported in the housing and configured to be driven by the motor, the pressure probe being in fluid communication with the air compressor.

10. The impact tool of claim 8, wherein the impact tool is configured to be connected to an external source of pressurized air, the pressure probe being in selective fluid communication with the source of pressurized air.

11. The impact tool of claim 1, further comprising an implement holder coupled to the housing of the impact tool, the implement holder being configured to a hold an implement that may be removably coupled the output shaft.

12. The impact tool of claim 1, wherein the impact mechanism comprises:

an anvil coupled to the output shaft and configured to rotate about the first axis; and a hammer configured to rotate about the first axis to periodically deliver an impact blow to the anvil to cause rotation thereof.

13. An impact tool comprising:

a housing;

a motor supported in the housing;

an output shaft supported by the housing, the output shaft configured to rotate about a first axis;

an impact mechanism supported in the housing, the impact mechanism comprising an anvil coupled to the output shaft and a hammer configured to rotate when driven by the motor to periodically deliver an impact blow to the anvil to cause rotation of the anvil and the output shaft;

a pressure probe coupled to the housing, the pressure probe being configured to couple to a valve of a motor vehicle tire to measure an air pressure of the motor vehicle tire; and a display supported by the housing, the display being configured to provide an indication of the air pressure of the motor vehicle tire measured by the pressure probe.

14. The impact tool of claim 13, wherein the housing includes a cavity formed therein, the cavity being configured to receive the pressure probe when not in use.

15. The impact tool of claim 14, wherein the pressure probe is rotatably mounted within the cavity such that the pressure probe is configured to be rotated out of the cavity for use.

16. The impact tool of claim 14, wherein the pressure probe includes a first arm rotatably mounted within the cavity and second arm rotatably mounted to the first arm.

17. The impact tool of claim 13, wherein the pressure probe is integrally formed as part of the housing and extends along a second axis that is non-parallel to the first axis.

18. The impact tool of claim 13, wherein the pressure probe is further configured to adjust the air pressure of the motor vehicle tire.

19. The impact tool of claim 18, further comprising an air compressor supported in the housing and configured to be driven by the motor, the pressure probe being in fluid communication with the air compressor.

20. The impact tool of claim 18, wherein the impact tool is configured to be connected to an external source of pressurized air, the pressure probe being in selective fluid communication with the source of pressurized air.

* * * * *